US008938828B2

(12) United States Patent
Kenalty et al.

(10) Patent No.: US 8,938,828 B2
(45) Date of Patent: Jan. 27, 2015

(54) ROLL UP EVACUATION MATTRESS

(71) Applicants: Christopher Kenalty, Toronto (CA); Miriam Gordon, Toronto (CA)

(72) Inventors: Christopher Kenalty, Toronto (CA); Miriam Gordon, Toronto (CA)

( * ) Notice: Subject to any disclaimer, the term of this patent is extended or adjusted under 35 U.S.C. 154(b) by 0 days.

(21) Appl. No.: 13/866,983

(22) Filed: Apr. 19, 2013

(65) Prior Publication Data

US 2013/0276235 A1 Oct. 24, 2013

Related U.S. Application Data

(60) Provisional application No. 61/635,469, filed on Apr. 19, 2012.

(51) Int. Cl.

| | |
|---|---|
| ***A47B 1/00*** | (2006.01) |
| ***A61G 1/01*** | (2006.01) |
| ***A61G 1/02*** | (2006.01) |
| ***A61G 1/013*** | (2006.01) |
| ***A61G 1/044*** | (2006.01) |

(52) U.S. Cl.

CPC ..... *A61G 1/01* (2013.01); *A61G 1/0206* (2013.01); *A61G 1/0287* (2013.01); *A61G 1/013* (2013.01); *A61G 1/02* (2013.01); *A61G 1/044* (2013.01)

USPC ..... 5/627; 5/81.1 HS; 5/625

(58) Field of Classification Search

USPC ..... 5/81.1 HS, 81.1 T, 625–629, 86.1; 280/19, 20; 128/870, 876; 296/20

See application file for complete search history.

(56) References Cited

U.S. PATENT DOCUMENTS

| | | | | | |
|---|---|---|---|---|---|
| 4,124,908 | A | * | 11/1978 | Burns et al. | 5/628 |
| 4,566,445 | A | * | 1/1986 | Jelsma et al. | 606/242 |
| 4,601,075 | A | * | 7/1986 | Smith | 5/628 |
| 4,736,474 | A | | 4/1988 | Moran et al. | |
| 4,793,008 | A | | 12/1988 | Johansson | |
| 4,922,562 | A | * | 5/1990 | Allred et al. | 5/627 |
| 5,044,031 | A | * | 9/1991 | Sherwood et al. | 2/69.5 |
| 5,050,254 | A | * | 9/1991 | Murphy | 5/625 |
| 5,088,137 | A | * | 2/1992 | Rose | 5/625 |
| 5,189,746 | A | * | 3/1993 | Horie | 5/627 |
| 5,386,604 | A | * | 2/1995 | Ricketts | 5/625 |
| D421,413 | S | * | 3/2000 | Calkin | D12/128 |
| 6,948,203 | B2 | * | 9/2005 | Tsai | 5/627 |
| 7,614,103 | B2 | * | 11/2009 | Beaudry et al. | 5/628 |
| 7,774,877 | B2 | | 8/2010 | Kenalty et al. | |
| 8,365,326 | B2 | | 2/2013 | Kenalty et al. | |
| 2002/0162171 | A1 | * | 11/2002 | Faz | 5/627 |
| 2007/0180625 | A1 | * | 8/2007 | Walke et al. | 5/706 |
| 2007/0278754 | A1 | | 12/2007 | Walkingshaw | |
| 2008/0134436 | A1 | * | 6/2008 | Beaudry et al. | 5/627 |

(Continued)

FOREIGN PATENT DOCUMENTS

WO 86/07253 A1 12/1986

*Primary Examiner* — Nicholas Polito
*Assistant Examiner* — Richard G Davis
(74) *Attorney, Agent, or Firm* — Katten Muchin Rosenman LLP

(57) ABSTRACT

A roll-up patient-evacuation mattress has a bottom sheet having a head end and a foot end. A mattress is disposed above the bottom sheet. A patient support sheet is disposed above the mattress, and has a left wing and a right wing which are dimensioned to respectively enclose at least portions of left and right sides of a patient lying on the patient support sheet. A foot section is coupled to the bottom sheet and is dimensioned to substantially enclose the patient-evacuation mattress when the bottom sheet, the mattress, and the patient support sheet are rolled from the head end to the foot end in a direction substantially parallel to a longitudinal axis of the patient-evacuation mattress into said foot section.

29 Claims, 16 Drawing Sheets

(56) References Cited

U.S. PATENT DOCUMENTS

2010/0005593 A1* 1/2010 Bowling et al. ..... 5/627
2010/0251479 A1* 10/2010 Kenalty et al. ..... 5/81.1 R
2010/0299836 A1* 12/2010 Tanaka et al. ..... 5/626
2011/0177733 A1* 7/2011 Grimes ..... 441/80
2012/0053423 A1 3/2012 Kenalty et al.

* cited by examiner

ROLL UP EVACUATION MATTRESS

CROSS-REFERENCE TO RELATED APPLICATIONS

This application claims priority to U.S. Provisional Patent Application No. 61/635,469, filed on Apr. 19, 2012, entitled "Roll Up Foam Evacuation Mattress", which is incorporated herein by reference.

TECHNICAL FIELD

The present invention relates to a roll-up mattress for rapid evacuation during emergency and non-emergency situations. More particularly, the invention relates to such a compact mattress that rolls up for stowage, but can be quickly deployed and used to evacuate an individual.

BACKGROUND INFORMATION

Evacuation sleds are used by hospitals, assisted living facilities, emergency services, etc., to rapidly and safely evacuate patients from danger zones, such as flood areas, fires, explosions, etc., or to transport patients from one location to another. The patient is typically transferred from a bed into the mattress (or sled), lowered to the floor, and then evacuated by pulling or dragging a tow strap affixed to the mattress. An efficient evacuation mattress (or sled) can be deployed and used by a single nurse or other care-giver. An evacuation mattress is disclosed in International Application Number PCT/NL 86/00015, published Dec. 18, 1986 under No. WO 86/07253, based on a Netherlands application filed Jun. 12, 1985. The mattress is characterized by belts or ropes to be put around the patient, which are permanently fastened to the mattress. Such a mattress, while very useful, may be relatively expensive to buy, store, and maintain.

While many sled-type patient evacuation devices are known (such as the evacuation sled disclosed in U.S. Patent Publication No. 2007/0278754 to Walkingshaw), these sleds require several care-givers to transfer the patient into the sled for evacuation, and typically comprise one thin sheet of semi-flexible plastic. The sleds are then dragged through the hospital, down numerous flights of stairs, and then to an evacuation center where the patient waits (often for hours) for transportation to a hospital, where the patient must be removed from the sled and placed in a bed (again requiring several care-givers). This leads to problems such as contusions in the patient from being bounced down steps, patient hypothermia, and the necessity for many care-givers to perform the multiple patient-transfer steps.

Other known structures for evacuating non-ambulatory persons include boards or mats to support the patient. For example, U.S. Pat. No. 4,793,008 to Johansson discloses rigid mats with straps, respectively placed beneath the patient's chest and thighs. A relatively complicated Rescue Transportation Mattress is disclosed in U.S. Pat. No. 4,736,474 to Moran et al., wherein an inflatable support member and crossed straps are used to secure the person being transported. Again, such solutions do little for a quick, safe, and warm evacuation of a patient from a facility during an emergency.

There are numerous other patents and patent applications employing rigid or semi-rigid supports and belts or straps to secure the person transported to the support. One apparent disadvantage to this use of straps or belts is that they could exert undue or excessive pressure on particular locations on the bodies of some evacuees, such as in the case of recent-surgery patients. Another disadvantage that is not obvious is that the use of many straps, harnesses, buckles, etc., delays the process of readying the patient for rescue and evacuation such as in the case of a hospital fire. More importunately, while they may be able to travel down stairs, none of prior art is capable of safely evacuating a person up a flight of stairs.

Thus, what is needed is an economical emergency mattress for evacuating patients from hospitals, subways, homes, high rises, etc., that is capable of operation by a single care-giver, may be rolled-up to fit within a compact space, provides a warm and secure cocoon for the patient, allows easy transport over any type of surface (e.g., up and down stairs), provides proper support for all of the patient's body, allows the patient to feel a high degree of comfort in what is otherwise a very stressful situation, and provides securing means (e.g., straps) to firmly hold the patient in place during transit.

SUMMARY

The present disclosure endeavors to provide an economical roll-up mattress for patients that overcomes certain of the problems noted above.

According to a first aspect of the present invention, a roll-up patient-evacuation mattress has a bottom sheet having a head end and a foot end. A mattress is disposed above the bottom sheet. A patient support sheet is disposed above the mattress, and has a left wing and a right wing which are dimensioned to respectively enclose at least portions of left and right sides of a patient lying on the patient support sheet. A foot section is coupled to the bottom sheet and is dimensioned to substantially enclose the patient-evacuation mattress when the bottom sheet, the mattress, and the patient support sheet are rolled from the head end to the foot end in a direction substantially parallel to a longitudinal axis of the patient-evacuation mattress into said foot section.

According to a second aspect of the present invention, a patient-evacuation mattress has a flexible bottom plastic sheet having a head end and a foot end. A first semi-rigid plastic sheet is disposed above the bottom sheet, and a foam mattress is disposed above the first semi-rigid plastic sheet. A flexible plastic patient support sheet is disposed above the foam mattress, and a second semi-rigid plastic sheet is disposed below the bottom sheet. At least two spinal boards are disposed between the bottom sheet and the first semi-rigid plastic sheet, each spinal board extending in a direction substantially perpendicular to a longitudinal axis of the patient-evacuation mattress and having at least three wheel assemblies coupled to a bottom surface thereof. The bottom sheet and the second semi-rigid plastic sheet each have at least one opening therein configured so that the spinal board wheel assemblies extend therethrough.

According to a third aspect of the present invention, a patient-evacuation sled has a bottom sheet having a top end, a bottom end, a right side, and a left side. A mattress is disposed above the bottom sheet, and a rigid support member is disposed between the bottom sheet and the mattress and extends from a middle of the bottom sheet toward the left and right sides thereof. Plural wheel assemblies are coupled to the rigid member and are configured to extend through the bottom sheet. A foot section is coupled to the bottom sheet and is configured to substantially enclose the feet of a patient lying above the mattress.

According to a fourth aspect of the present invention, a patient-evacuation device has a bottom sheet having a top end, a bottom end, a right side, and a left side. A mattress is disposed above the bottom sheet, and a rigid support member is disposed between the bottom sheet and the mattress and extends from a middle of the bottom sheet toward the left and right sides thereof. Plural wheel assemblies are coupled to the rigid member and are configured to extend through the bottom sheet. A left patient-enclosure flap is coupled to the bottom sheet left side and is configured to enclose at least a portion of a left side of a patient lying above the mattress. A right patient-enclosure flap is coupled to the bottom sheet right side and is configured to enclose at least a portion of a right side of a patient lying above the mattress. Plural patient-enclosure straps are coupled to the left and right patient-enclosure flaps and are configured to secure the patient to the evacuation device. The left and right patient-enclosure flaps are configured to leave exposed the head and knees of the patient lying above the mattress.

BRIEF DESCRIPTION OF THE DRAWINGS

FIG. 21 is a top plan view of the bottom sheet showing a thermal blanket add-on.

DETAILED DESCRIPTION OF THE PRESENTLY PREFERRED EXEMPLARY EMBODIMENTS

Preferred embodiments of the present invention will be described herein below with reference to the accompanying drawings. In the following description, well-known functions or constructions are not described in detail since they would obscure the invention in unnecessary detail.

Figure 3:
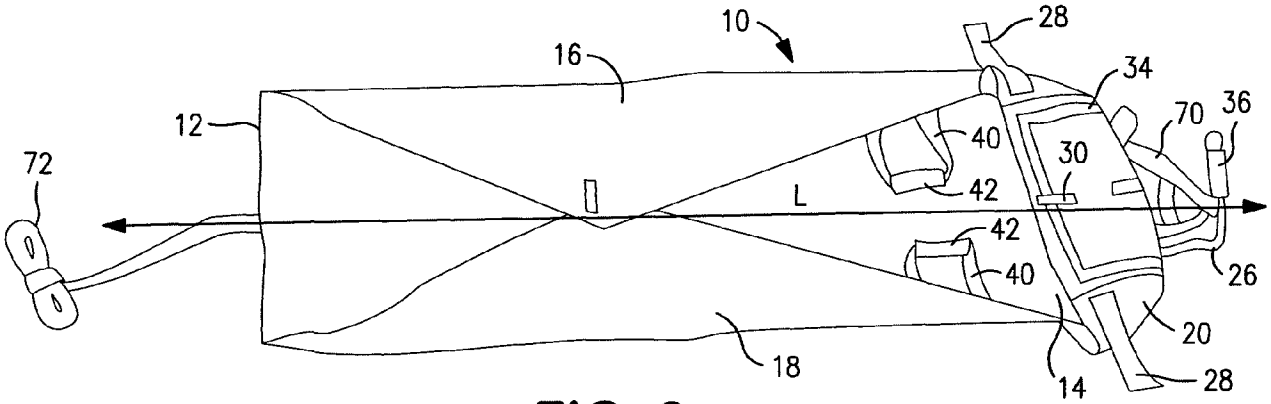
FIG. 3 is a side perspective view of the FIG. 1 embodiment in a unrolled state.

As to nomenclature (and with reference to FIG. 3), each evacuation mattress 10 has a "head" end 12 (where the patient's head will be positioned), a "foot" end 14, a "left" wing 16 (when viewed from the supine patient's position), and a "right" wing 18. With the patient lying in the mattress positioned on the ground, as in FIG. 3, "above" will refer to the direction in which the patient looks, and "below" will refer to the opposite direction. The mattress has a longitudinal axis L, as also seen in FIG. 3.

Figure 1:
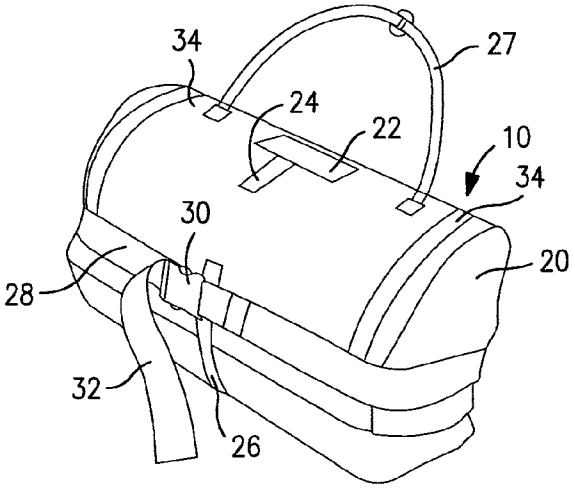
FIG. 1 is a side perspective view of the rolled up patient evacuation mattress according to a first embodiment of the present invention.

FIG. 1 is a side perspective view of the rolled-up patient evacuation mattress 10 according to a first embodiment of the present invention. The rolled-up mattress presents a generally cylindrically-shaped structure with the mattress rolled-up into a foot section 20. Preferably, the rolled-up mattress is approximately 20-36 inches long, and 10-12 inches in diameter, and weighs approximately 14 pounds. A portion of the cylinder is preferably flat, 20-36 inches long by 10 inches wide. This allows the mattress to lie stably on the floor. A label pouch 22 comprises a clear plastic envelope which may contain information such as patient information, mattress information, hospital information, or a blank sheet which may be used by triage personnel. A hook-and-loop fastener 24 (such as Velcro™) can be used to affix various devices to the mattress, such as tags, cords, etc. A circumferentially-disposed closure strap 26 is used to keep the mattress in the rolled-up position, and may be affixed to the mattress and/or other portions of the closure strap. The closure strap 26 has releasable closure structure such as hook-and-loop, plastic releasable-buckles, etc. Perpendicular to the closure strap 26 is an adjustable closure strap 28, which includes a releasable buckle 30 with an adjusting strap portion 32 used to tighten the adjustable closure strap 28. An optional shoulder strap 27 may also be affixed to the foot section 20. Preferably, highly-reflective tape 34 is sewn to the outside of the foot section 20, to aid in location and safety during evacuation. The mattress 10 (FIG. 3) may be approximately 35.5 inches wide×80 inches long×1.5 inches thick, but may be larger or smaller depending on the size of the individual being carried. For example, in bariatric situations, the mattress my be substantially wider in order to accommodate the girth of the patient.

Figure 2:
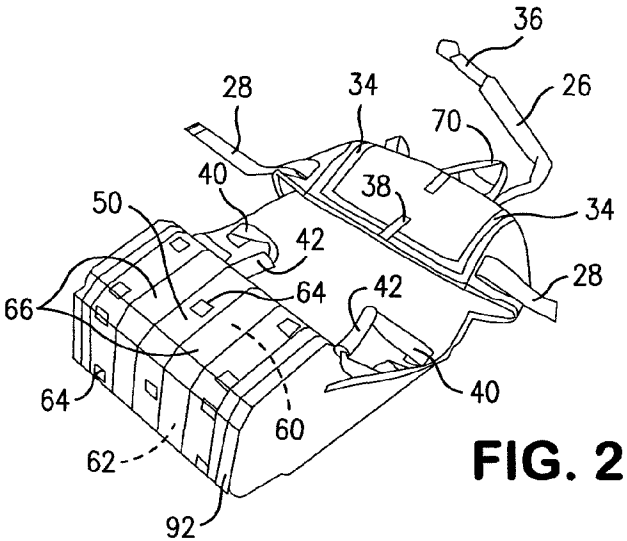
FIG. 2 is a side perspective view of the FIG. 1 embodiment, in a semi-unrolled state.

FIG. 2 is a side perspective view of the FIG. 1 embodiment in a semi-unrolled state. The adjustable closure strap 28 has been released, and a hook-and-loop fastener 36 of the closure strap 26 has been disengaged from it's hook-and-loop fastener-mate 38. Side leg handles 40 are depicted with foam rubber (e.g., Neoprene™) handle liners 42 releasably fixed thereto by means such as metal snaps, buttons, hook-and-loop fasteners, etc. Of course, the foam rubber handle liners 42 may be permanently fixed to the leg handles 40 by sewing, etc. A foot end towing strap 70 (to be described below) is seen partially deployed.

In FIG. 2, a bottom sheet 50 is shown, with underlying, rigid spinal boards 60, 62 (to be described below). Fixed to each spinal board are at least two (preferably five) wheel assemblies 64 (also to be described below) which have wheel portions protruding through openings in the bottom sheet 50. Preferably, fabric wear strips 66 are affixed to the bottom sheet 50, in-between the wheel assemblies (as shown), to protect the bottom sheet 50 when the mattress 10 is dragged along a surface. The wear strips 66 may comprise Kevlar (which has an excellent co-efficient factor), ballistic nylon (which is a thick, tough, synthetic nylon fabric), or other suitable fabric.

FIG. 3 is a side perspective view of the FIG. 1 embodiment in a unrolled state. Each of the left and right wings 16, 18 preferably has a substantially triangular shape so that the patient's head remains exposed (for treatment and communication), as well as the patient's knees (for easy access to medical devices, which are often transported between a patient's knees and lower legs). A head towing strap 72 is shown partially deployed.

Figure 4A:
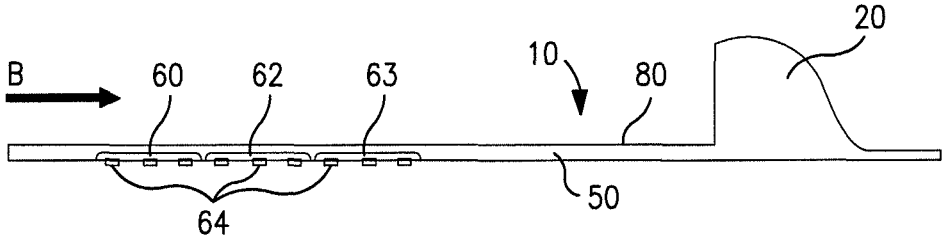
FIGS. 4*a*, 4*b*, and 4*c* are schematic side views of a second embodiment according to the present invention showing the rolling-up of the patient evacuation mattress.
Figure 4B:
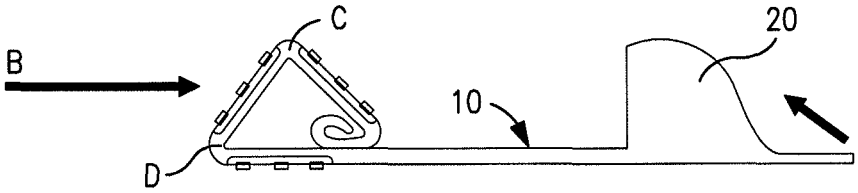
Figure 4C:
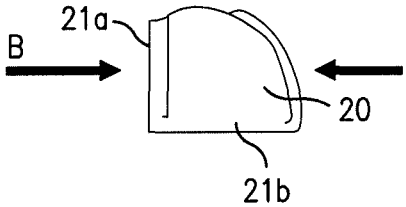

FIGS. 4*a*, 4*b*, and 4*c* show the rolling-up of the patient evacuation mattress 10 in the direction of Arrow B. In FIG. 4*a*, the spinal boards 60, 62, and 63 are shown in cross-section, each with five wheel assemblies 64 protruding through the bottom sheet 50. Preferably, there are at least two spinal boards (most preferably three, but four, five, six, or seven may be used). Again preferably, the spinal boards are disposed more toward the head end than the foot end of the mattress 10, in order to better support the weight of the patient, which is typically concentrated more toward the chest than the legs. The spinal boards are disposed between the bottom sheet 50 and a patient support sheet 80, with spaces between the spinal boards to act as hinges when the mattress 10 is rolled-up toward the foot section 20. In FIG. 4*b*, the mattress 10 is half-rolled-up, with the spinal boards articulated with respect to each other about hinge axes C and D, which are substantially perpendicular to the mattress longitudinal axis L. In FIG. 4*c*, the mattress 10 has been completely rolled-up into the foot section 20, presenting a substantially cylindrical cross-section, preferably with two flat or semi-flat portions 21*a* and 21*b*.

Figure 5:
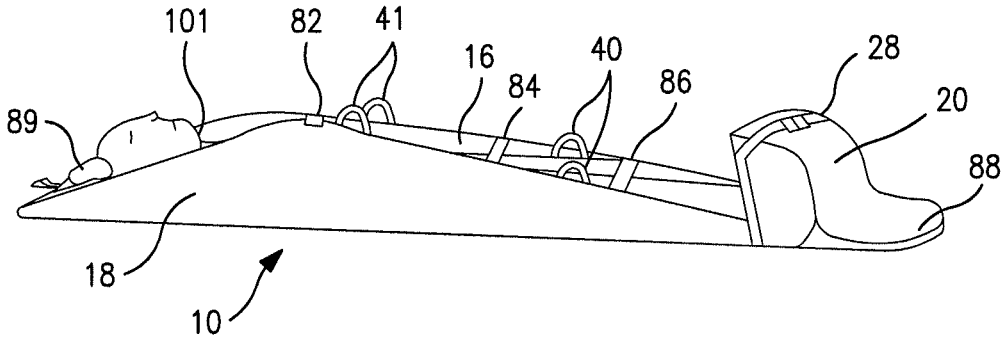
FIG. 5 is a side perspective view of the FIG. 4*a* embodiment showing a patient lying on the mattress.

FIG. 5 is a side perspective view of a patient 101 lying on the mattress 10. Leg handles 40 and shoulder handles 41 are seen protruding from the edge of wings 16 and 18. The adjustable closure strap 28 is seen over foot section 20, and the patient's feet are preferably enclosed inside the foot section 20. This helps to protect the feet and to keep them warm. The foot section 20 can also hold bedding, fabric sheets, etc., which may be evacuated with the patient. Three patient-securing straps are shown: chest securing strap 82, waist securing strap 84, and leg securing strap 86. An optional brake portion 88 is shown protruding tangentially from the foot section 20. During an evacuation, if the mattress and patient are moving too quickly (as is a stairs descent), the care-giver can merely apply downward pressure to the brake portion 88 (for example, by stepping on it or pressing it with a hand or other body part, or an inanimate object) to slow the movement of the patient and mattress. Also optionally, a pillow 89 may be placed under the patient's head for comfort, and cushioning from bumps and bruises.

Figure 6:
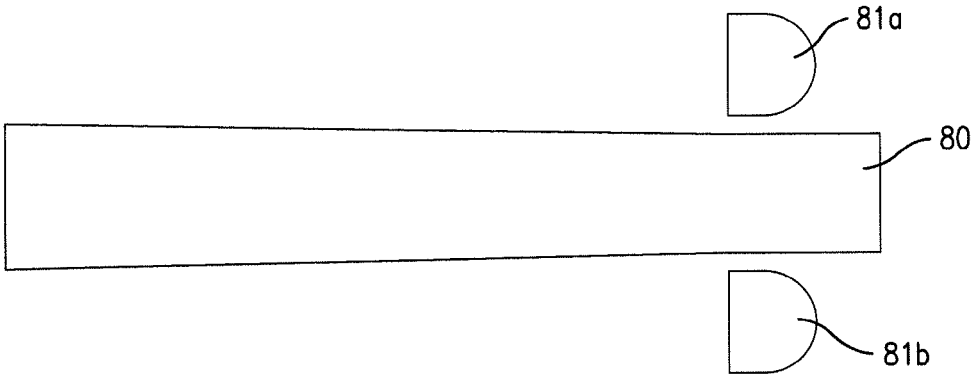
FIG. 6 is a top plan view of the patient support sheet according to the FIG. 4*a* embodiment.

FIG. 6 is a top plan view of the patient support sheet 80, upon which the patient is placed. The patient support sheet 80 (and the bottom sheet 50) is preferably constructed from a material that meets infection control measures, but may also contain microclimate features. In a preferred embodiment, the skin may be constructed from SoffTICK™ Standard Institutional Fabric Ultra 53-14, available from Vintex Inc. at www.vintex.com. Ultra 53-14 is advantageous because it is soft, flame retardant, durable, resistant to bacteria/fungal growth, self-deodorizing, hypo-allergenic, non-irritating and foam compatible, plastic sheet material. The entire bottom sheet 50 may be made from the Ultra 53-14 or from a more durable material. Suitable materials include, for example, Kevlar, or ballistic nylon, which may cover only a portion of the bottom sheet 50. Forming the entire lower sheet from a single durable material, although typically more expensive than regular skin, would eliminate the need to cut and bond a second material to the lower skin thereby reducing labor and some material costs.

An alternative solution to maintaining an anti-fugal and anti-bacterial mattress surface 80 may be to coat the mattress skin with spray-on liquid glass (also referred to as "$SiO_2$ ultra-thin layering"). Spray-on liquid glass is transparent, non-toxic, and can protect virtually any surface against almost any damage from hazards such as water, UV radiation, dirt, heat, and bacterial infections. Liquid glass coating is also flexible and breathable, making it suitable for use on both traditional mattresses and evacuation mattress (e.g., the roll up mattress).

In FIG. 6, the patient support sheet 80 preferably comprises a rectangular shape approximately 238 cm long, 55 cm wide at the head end, and 52 cm wide at the foot end. As an alternative, the patient support sheet 80 may have left and right wing portions, which would have the same shape/dimensions as the wings on the bottom sheet 50 (to be discussed below). Left and right end panels 81*a* and 81*b* preferably each have a hemispherical shape and can be sewn, glued, stapled, and/or welded to the foot portion of the patient support sheet 80 to form the ends of the cylindrical foot section 20.

Figure 7:
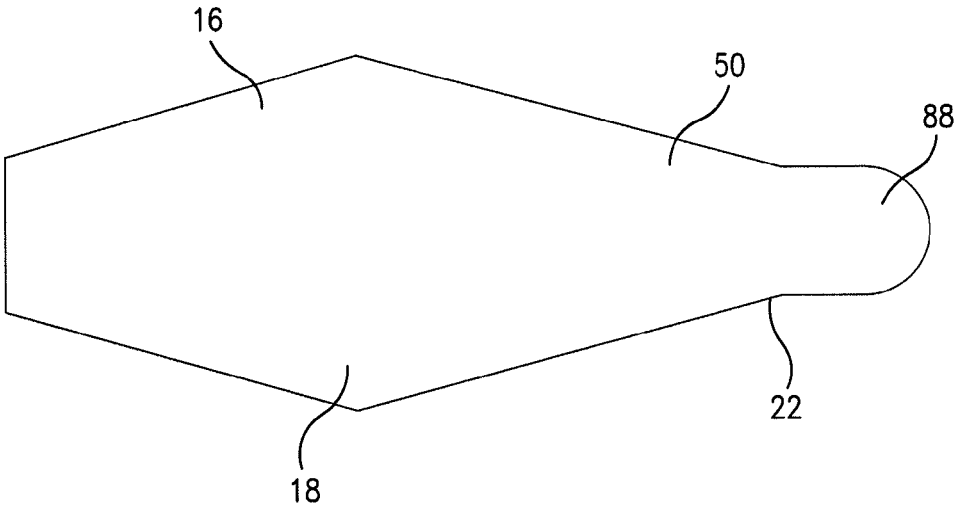
FIG. 7 is a top plan view of the bottom sheet according to the FIG. 4*a* embodiment.

FIG. 7 is a top plan view of the bottom sheet 50, preferably made of the same material as the patient support sheet 80. Brake portion 88 is shown as an extension of the bottom sheet 50, but may comprise a separate piece sewn, glued, stapled, and/or welded to the bottom sheet 50. Preferably, the bottom sheet 50 is 194 cm long (with the brake portion 88 being an additional 32 cm long), 47 cm wide at the foot section 22 and 55 cm wide at the head section. Each wing 16 and 18 preferably comprises a triangular shape with a base 194 cm long, a leg-side length 130 cm long, and a chest-side length 75 cm long, integral with the sheet 50 (but the wings may be sewn, stapled, glued, welded, etc., to the sheet 50).

Figure 8:
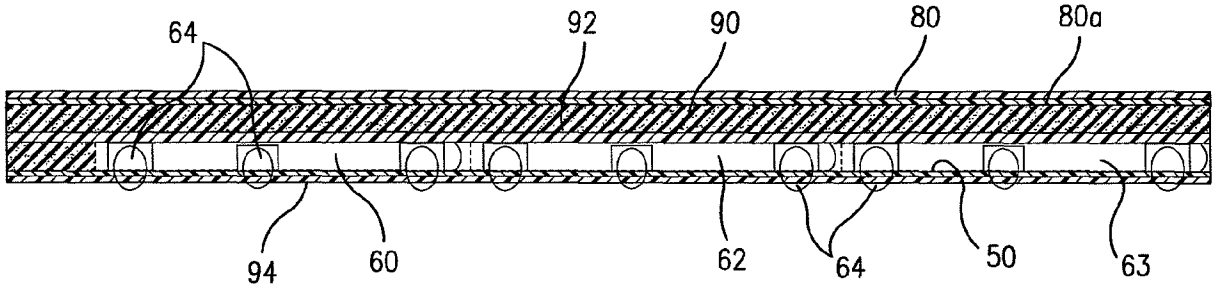
FIG. 8 is a schematic, cross-sectional view according to the FIG. 4*a* embodiment.

FIG. 8 is a schematic, cross-sectional view of the mattress 10. Patient support sheet 80 preferably lies under the patient, and an optional (but preferred) second layer of SoffTICK™ 80*a* is sewn, glued, stapled, and/or welded underneath the patient support sheet 80. Beneath this sheet is the foam mattress 90, which is used as a cushion and to conserve warmth for the patient. The foam mattress 90 may be ½ inch thick and be dimensioned slightly smaller than the patient support sheet 80. The foam material may comprise a fire-retardant, anti-fungal, open-cell material such as Vita B2721T1N urethane foam, available from Vitafoam Canada. Beneath the foam mattress 90 is a reinforcing plastic sheet 92, preferably fixed to the foam mattress 90 by gluing, stapling, sewing, or welding. The reinforcing plastic sheet 92 preferably comprises two parallel sheets of rigid or semi-rigid plastic connected together by a series of orthogonal connecting walls running substantially perpendicular to the mattress longitudinal axis. A preferred reinforcing plastic sheet is Polyethylene Plastic made by Modern Age Plastics Inc. of Toronto, Canada. The reinforcing plastic sheet 92 is preferably 1/16 to ½ inch thick, most preferably ⅛ inch thick, and dimensioned substantially to be ⅛ to ½ inches (preferably ¼ inches) wider/longer than the foam mattress 90. The reinforcing plastic sheet 92 provides structural stability to the foam mattress 90, and further shields the patient from the ground and the spinal boards. The main role of the spinal boards 60, 62, 63 is to provide additional support in the back and spinal regions. This support is particularly important when transporting an injured person (e.g., when lowering from a window, up or down a flight of stairs, etc.) because, not only will the person require additional back support, but the care-giver will require that the mattress stay somewhat planar when the person is being transported. The spinal boards provide substantial rigidity transverse to the longitudinal axis while the patient would provide needed rigidity to the longitudinal axis.

Also in FIG. 8, spinal boards 60, 62, and 63 are shown disposed between the plastic reinforcing sheet 92 and the bottom sheet 50. Each spinal board is typically constructed from a plastic material (e.g., Polystyrene, PVC, Nylon, or other polymers, including high performance polymers) and has dimensions approximately 0.5×7.5×15.75 inches. While a 15.75 inch board is sufficient for a majority of people, in bariatric cases, the width may be increased to accommodate a larger body type. Alternately, the spinal boards may be placed side by side to increase the overall width. Preferably, the spinal board is a high density polyethylene or HDPE. A preferred plastic is made by Modern Age Plastics Inc., Canada.

Each spinal board may include a plurality (e.g., 3, 4, 5, or 6) of square openings, each approximately 1 inch×1 inch, where each is capable of receiving a wheel assembly 64 or other wheel structure. A wheel assembly 64 may be snapped, or clipped, into each square opening. Using replaceable wheel assemblies 64 that may be snapped into and out of the spinal board, as opposed to those that are permanently attached or integrated therein (which are also within the scope of the invention), allows for easy replacement should a wheel break or otherwise malfunction. This configuration also allows for interchanging the wheels for different sizes/weights/surfaces. Each wheel may be generally comprised of a single wheel within a housing, typically with an axle. The housing is configured to fit snugly within the square opening in the spinal board, and may include side pressure clips which snap the wheel assembly in place once in the spinal board. However, it should be appreciated that the roll-up mattress is not limited to this type of wheel assembly. If the mattress is used in a snowy region, for example, it may be advantageous to completely omit casters all together and/or to use small skid plates.

In a preferred embodiment, little-to-none of the materials used to fabricate the spinal board would be metallic or any other material that may interfere with an X-ray machine. This is important because the roll-up mattress 10 may stay with the patient even during X-ray procedures, particularly when the patient is in a delicate state and should not be moved until X-rays are complete. Suitable materials would include, for example, various plastics, Polystyrene, PVC, Nylon, or other polymers, including high performance polymers. Each spinal board preferably has plural wheel assemblies 64, which provide proper rolling support for the patient. Preferably, the plural wheel assemblies are respectively disposed along three axes substantially perpendicular to the mattress longitudinal axis. The wheel assemblies may comprise individual wheels mounted on individual axles, but may comprise cylindrical rollers extending all or part way across the length of the spinal board, and/or ball-bearings, and/or any known and convenient means to support the patient's movement along a surface. The most preferred embodiment has five individual wheel assemblies 64 fixed to the bottom of each spinal board, with one wheel assembly near each of the four corners of the spinal board, and one wheel assembly disposed substantially in the center of the spinal board.

Further in FIG. 8, the bottom sheet 50 has one or more holes or openings therein for the wheels to extend through so that the wheels contact the surface. In a preferred embodiment, a wheel bracket (FIG. 2) which holds the wheel axle is used to fix the spinal board to the bottom sheet 50. Beneath the bottom sheet 50 is, preferably, a second reinforcing plastic sheet 94, which is similar to the reinforcing plastic sheet 92, but serves not only to reinforce the structural integrity of the mattress 10, but serves as a skid/wear/slip plate to keep the bottom sheet 50 from being degraded as the mattress 10 moves along a surface. Preferably, the second reinforcing plastic sheet 94 has one or more opening therein so that the wheel assemblies 64 may be exposed to the surface, as shown schematically in FIG. 2. Where the second reinforcing plastic sheet 94 has the one or more openings, a reinforcing fabric 66 is preferably fixed to the bottom sheet 50 (as shown in FIG. 2) to further protect the bottom sheet 50 where the second reinforcing plastic sheet 94 can not shield it. The reinforcing fabric 66 generally runs in longitudinally-extending strips between the wheel assemblies 64. The second reinforcing plastic sheet 94 may be affixed to the bottom sheet 50 by gluing, sewing, stapling, etc.

Figure 9:
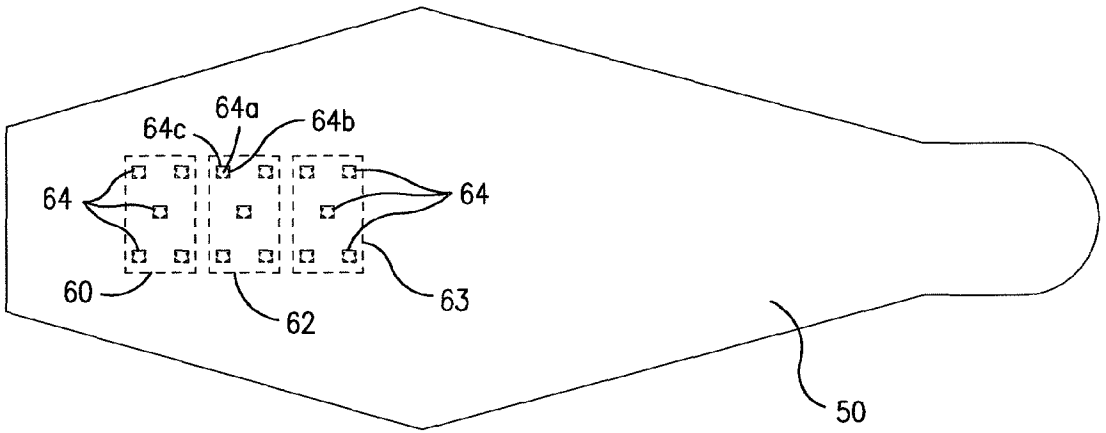
FIG. 9 is a bottom plan view of the bottom sheet, showing the spinal boards and protruding wheel assemblies according to the FIG. 4*a* embodiment.

FIG. 9 is a bottom plan view of the bottom sheet 50 showing the spinal boards 60, 62, and 63 and protruding wheel assemblies 64. Each wheel assembly preferably comprises a wheel 64*a*, axle 64*b*, and bracket 64*c*, which are all preferably visible from the bottom of the mattress 10.

Figure 10:
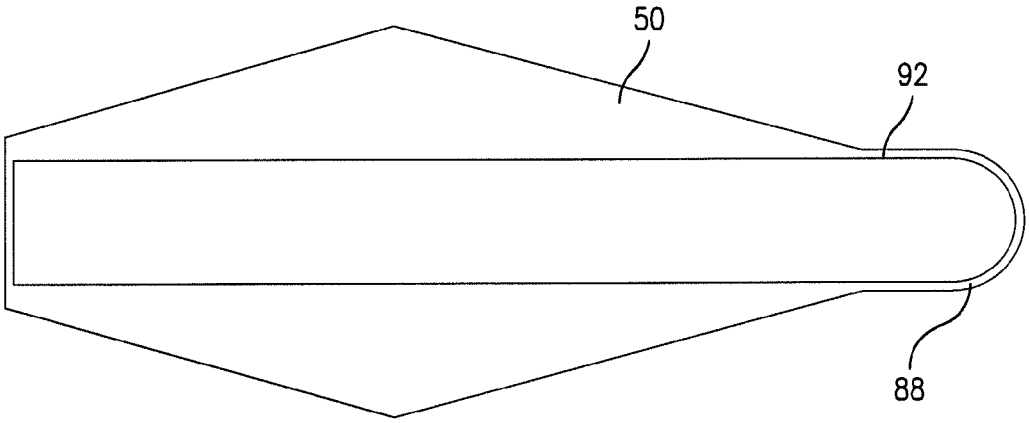
FIG. 10 is a top plan view of the first plastic reinforcing sheet disposed on the bottom sheet according to the FIG. 4*a* embodiment.

FIG. 10 is a top plan view of the first reinforcing plastic sheet or layer 92 disposed on the bottom sheet 50. Preferably, the first reinforcing plastic sheet 92 extends longitudinally into the brake portion to give further rigidity thereto. Preferably, the first reinforcing plastic sheet 92 is 220 cm long, 40 cm wide and 0.5 cm thick.

Figure 11:
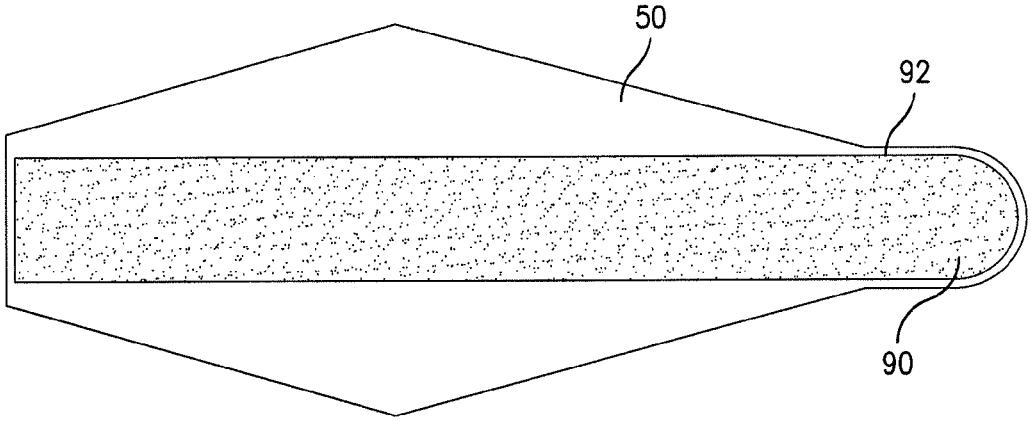
FIG. 11 is a top plan view of the foam mattress disposed on the first plastic reinforcing sheet according to the FIG. 4*a* embodiment.

FIG. 11 is a top plan view of the foam mattress 90 disposed on the first reinforcing plastic sheet 92. Preferably, the foam mattress 90 is fixed to the first reinforcing plastic sheet 92 by gluing, stapling, sewing, etc. Preferably, the mattress is 114 cm long and 34 cm wide.

Figure 12:
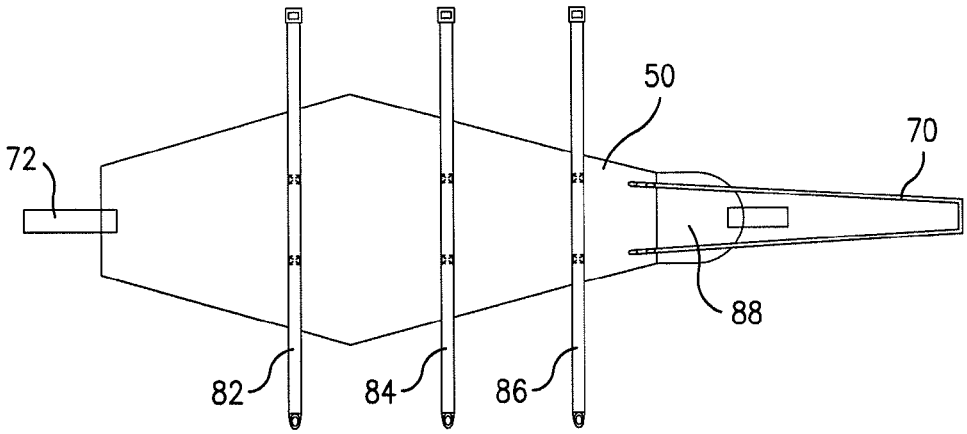
FIG. 12 is a bottom plan view of the bottom sheet showing strap connections according to the FIG. 4*a* embodiment.

FIG. 12 is a bottom plan view of the bottom sheet 50 showing the strap connections. The roll up mattress 10 utilizes a number of securing straps to ensure that the person being transported is completely secure, thus restricting any shifting. In fact, once strapped in, the patient may be vertically transported without shifting off the mattress. The preferred embodiment has the chest securing strap 82, the waist securing strap 84, and the leg securing strap 86, although more or fewer straps may be used depending on the size of the mattress and the size of the patient. Each strap is preferably sewn to the central portion of the bottom sheet 50, at two places, as shown. Each securing strap is preferably adjustable in length to accommodate both larger and smaller people and is generally comprised of two lengths of strap material coupled end-to-end with an adjustable detachable connection (e.g., a traditional buckle, Side-Release Interlocking Buckle, Cam Lock Buckle, etc.). The bottom portions of the securing strap may be permanently attached to a point on the mattress using traditional strap stitching techniques, melted, glued or fused with the bottom sheet. In certain embodiments, the securing straps may be detachably secured to the mattress 10 (e.g., using buckles, snaps, buttons, hooks and loops, etc.). A detachable securing means may be beneficial in situations where the straps have worn out or need to be replaced with a different version or size.

The straps may be constructed from a strong fabric woven as flat strips and/or tubes. The flat type of material is more commonly known as webbing. The webbing may be woven from, for example, nylon, polypropylene, polyester, high-modulus polyethylene (e.g., Dyneema®), para-aramid synthetic fiber (e.g., Kevlar®), cotton, flax, and combinations thereof. While the webbing used to form the straps may be flat, for added strength, the webbing may partially encircle a core material, or be folded lengthwise around the core material. To seal the core material within the webbing, the edges of the webbing may be stitched, fused, or otherwise sealed along portions of the length of the strap portion or portions having a core, thereby preventing the core material from becoming disassociated with the webbing. The core material may be, for example, rope, hollow tube, cabling, etc. To the extent that communications or patient-monitoring electronics are incorporated into the evaluation mattress 10, wires, fiber optics, or other conductors may be embedded within the core (e.g., within a tube or conduit) to communicate signals from end to end.

In a further embodiment, a set of shoulder securing straps may be configured to secure the shoulders of the person being transported to the mattress. A first end of each shoulder securing strap is attached to a point on the patient support sheet just above the respective shoulder. A second end of each shoulder securing strap is attached to a point on the patient support sheet just below the respective shoulder, typically in the arm pit region. The shoulder securing strap's length may be adjusted via an adjustable connection until the shoulders are secured in place against the mattress.

The chest securing strap 82 traverses the patient's chest region while simultaneously securing both the arms and body. As seen in the FIG. 12, each end of the chest securing strap 82 may be attached to the mattress at two points, one on each side of the person's torso. The chest securing strap's length may be adjusted via the adjustable connection until the chest secured in place.

Similarly, the waist securing strap 84 traverses the patient's waist/hip region, securing the person's hip area. As seen in FIG. 12, each end of the waist securing strap 84 may be attached to the mattress at two points, on each side of the patient's waist. Like the chest securing strap 82, the hip securing strap's 84 length may be adjusted via the adjustable connection until the waist area is secured in place. An optional groin securing strap may be provided to secure the groin region of the body and, along with the other securing straps, prevent the patient from sliding vertically. A first end of the groin securing strap may be attached to the mattress between the legs, in the groin region, while a second end of the groin securing strap may be attached to the waist securing strap 84 (e.g., via a Three Way Side Release Buckle). A three way side release buckle would allow for a single buckle to quickly secure both the patient's waist securing strap 84 and the groin securing strap.

In certain embodiments, the leg securing strap 86 may traverse the person's calf or foot region to further secure the person and prevent any shifting of the legs. As seen in FIG. 12, each end of the leg securing strap 86 may be attached to the mattress at two points, on each side of the person's lower leg region. Like the other securing straps, the leg securing strap's length may also be adjusted via the adjustable connection until the legs are secured in place.

Although the preferred embodiment features the various securing straps as parallel or perpendicular to the person's body, it should be appreciated that the straps may be installed diagonally and/or crossways. For example, the chest securing strap and hip securing strap may be installed, or connected, such that the straps form an 'X' over the person's stomach region. In fact, if side release buckles are used, a single construction may be used where both a parallel and diagonal configuration may be possible, depending on how the caregiver chooses to secure the patient. Similarly, the shoulder straps may also be install, or connected, such that the straps form an 'X' over the person's shoulder/upper body region. Certain of these alternatives will be discussed below with respect to FIGS. 15*a*, 15*b*, 15*c*, and 15*d*.

As also shown in FIG. 12, installed at each end of the mattress are towing straps 70 and 72. In preferred embodiments, the head end towing strap 72 is used to pull the patient while the foot end towing strap 70 may be used to guide the patient's movement. However, both the towing strap at the head end and the towing strap at the foot end are equally capable of being used to pull and/or to guide the patient during transit. For added durability, the towing straps 70 and 72 may be anchored or sewn into the various mattress layers, including the bottom sheet 50. In certain embodiments, the head end towing strap 72 and foot end towing strap 70 may be constructed from a single continuous piece of strap material which travels the length of the mattress and provides additional durability. In yet another embodiment, the head end towing strap 72 and/or foot end towing strap 70 may be attached to one or more spinal boards 60, 62, and/or 63. In yet another embodiment, the head end towing strap 72 and/or foot end towing strap 70 may be formed in "ladder"-like arrangements with one, two, three, or more intermediate cross straps for varying pulling distances.

Figure 13:
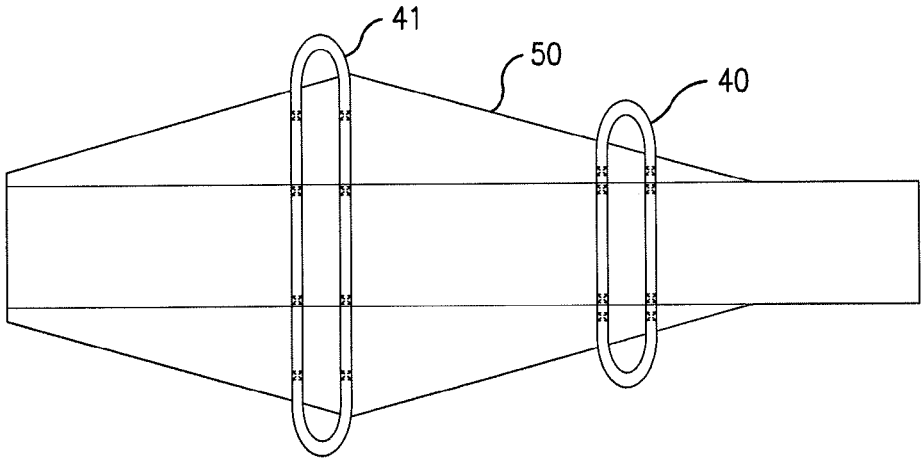
FIG. 13 is a bottom plan view of the bottom sheet showing lifting handle connections according to the FIG. 4*a* embodiment.

FIG. 13 is a bottom plan view of the bottom sheet 50 showing lifting handles 40 and 41, positioned on each side of the mattress, for use when carrying the mattress/person. Although four handles are shown in FIG. 13 (two on each side), a person of ordinary skill in the art would appreciate that greater or fewer handles may be installed depending on the size of the handles and the size of the mattress and/or patient. For example, when a larger person is being transported, additional handles may be preferred so that each medical response person can carry a handle, to better distributing the weight. This is particularly helpful when the patient is being loaded into an ambulance, a task which often requires the paramedics to lift the patient three to four feet off the ground.

As illustrated in FIG. 2, the handles (or handholds) 40 and 41 may be further padded at 42 to provide additional comfort. For example, a padded material, such as Neoprene™ (i.e., polychloroprene) or a high density foam, may be removably coupled to the handle portion using, for instance, snaps or hook-and-loop fasteners. Alternatively, the handles may be constructed from a length of material, such as a strap, rope, or webbing, wherein the distal ends of the length of material are attached to the bottom sheet to form a handle shape (e.g., a U-shape).

For added durability, handles 40 and 41 and/or the straps 82, 84, 86 may be anchored or sewn into the various layers of the mattress, in addition to or instead of the bottom sheet 50. In certain embodiments, each handle 40 and 41 may be constructed from a single continuous piece of strap material which travels the width of the mattress and provides additional functionality by supporting the patient from underneath. In yet another embodiment, the handles 40 and 41 may be attached to one or more of the spinal boards 60, 62, and 63.

When the mattress is supported by the handles 40 and 41 from a single point (e.g., suspended from a rope sling), the spinal boards 60, 62, and 63 provide rigidity to the patient's back while the wings come up to form a wall, or safety cocoon. Depending on the condition of the patient, it may be necessary to air lift the patient to the nearest hospital. In this situation, the handles may be connected to a helicopter winch or harness and lifted to safety.

In certain embodiments, the head and foot wrappings of the conventional Supersled™ or Evacu-slide™ mattresses may also be added to provide additional protection to the person being transported. See, for example, U.S. Pat. No. 7,774,877, U.S. Patent Publication No. 2010/0251479A1, U.S. patent Ser. No. 12/862,253 and U.S. patent Ser. No. 12/700,027, all to Christopher Kenalty. Each of these teaches an evacuation mattress, evacuation sled, and/or smart mattress. These beneficial features, including smart mattress functionality and supplemental bedding, may be incorporated with the roll up mattress.

Figure 14A:
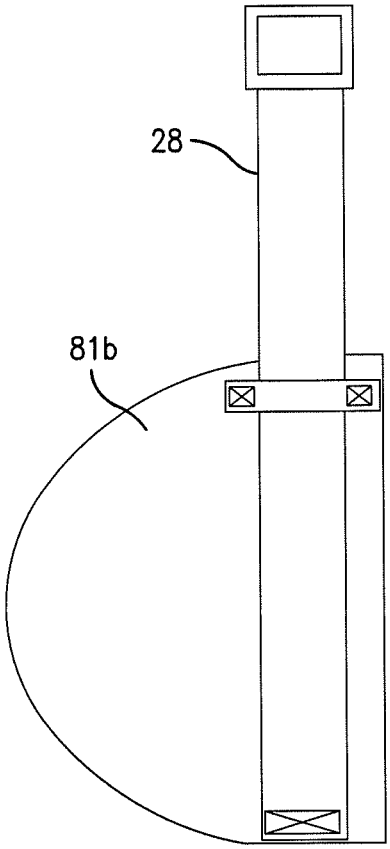
FIGS. 14*a* and 14*b* are top plan views of the foot section end panels according to the FIG. 4*a* embodiment.
Figure 14B:
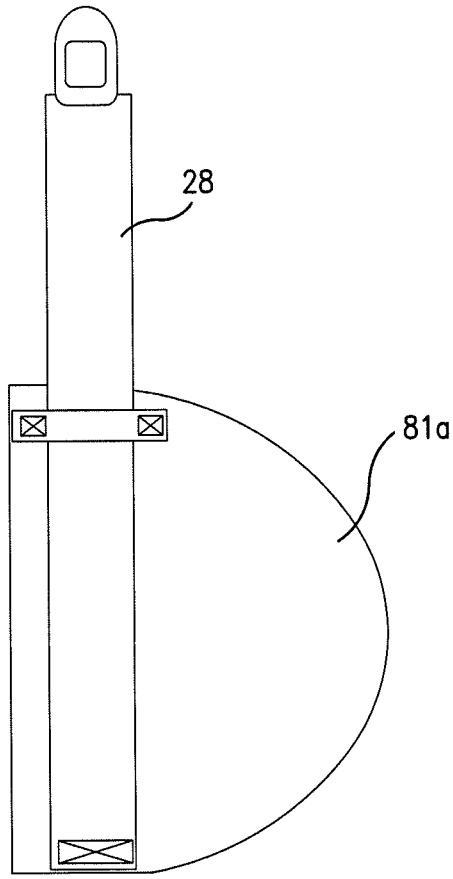

FIGS. 14*a* and 14*b* are top plan views of the foot section end panels 81*a* and 81*b*. The two portions of the adjustable closure strap 28 are fixed to the end panels by sewing, gluing, stapling, etc.

Figure 15A:
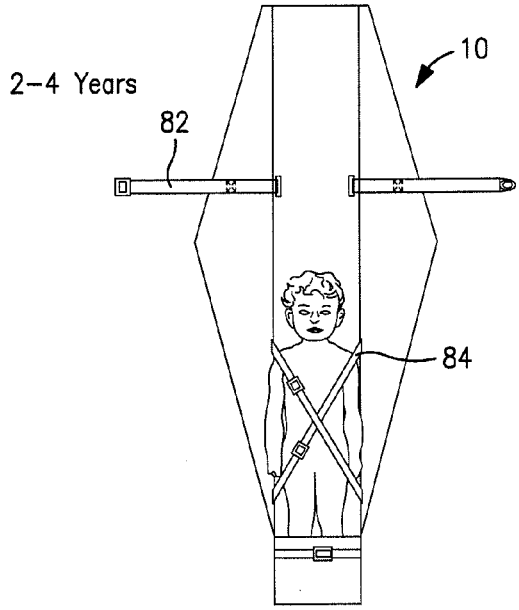
FIGS. 15*a*, 15*b*, 15*c*, and 15*d* are schematic top views showing different strapping arrangements for toddlers, children, teens, and adults, respectively, according to the FIG. 4*a* embodiment.
Figure 15B:
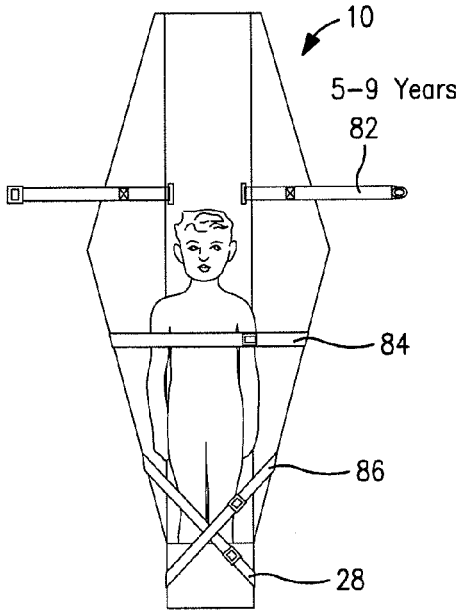
Figure 15C:
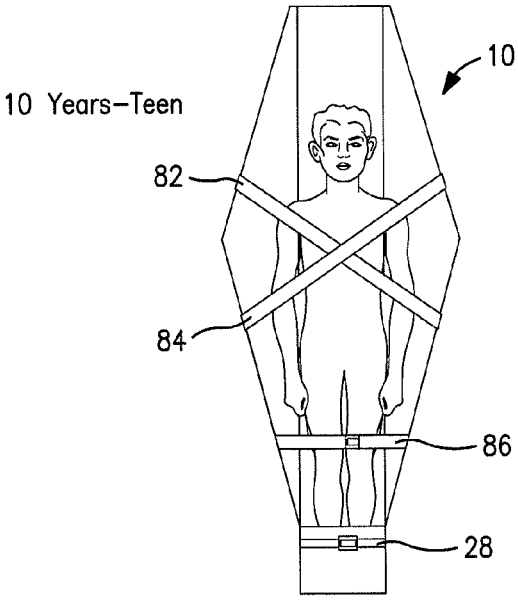
Figure 15D:
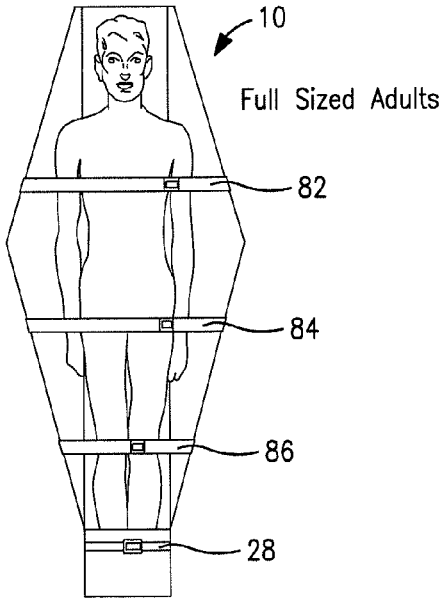

FIGS. 15*a*, 15*b*, 15*c*, and 15*d* are schematic top views showing different strapping arrangements for toddlers, children, teens, and adults, respectively. In FIG. 15*a*, a toddler is strapped into mattress 10 by crossing the two parts of the waist strap 84 and the leg strap 86, as shown, to secure the toddler in-place. The adjustable closure strap 28 can be used to secure the toddler's feet, as shown. For a child, FIG. 15*b* shows that the waist strap 84 can be used, normally, as the child's chest strap. The two parts of the leg strap 86 can then be crossed and coupled to the two parts of the adjustable closure strap 28, as shown. For a teen, the chest strap 82 can be crossed with the waist strap 84 to secure the teen's upper body, while the leg strap 86 can be used normally, as shown in FIG. 15*c*. For adults, the straps are used normally, as shown in FIG. 15*d*.

Figure 16:
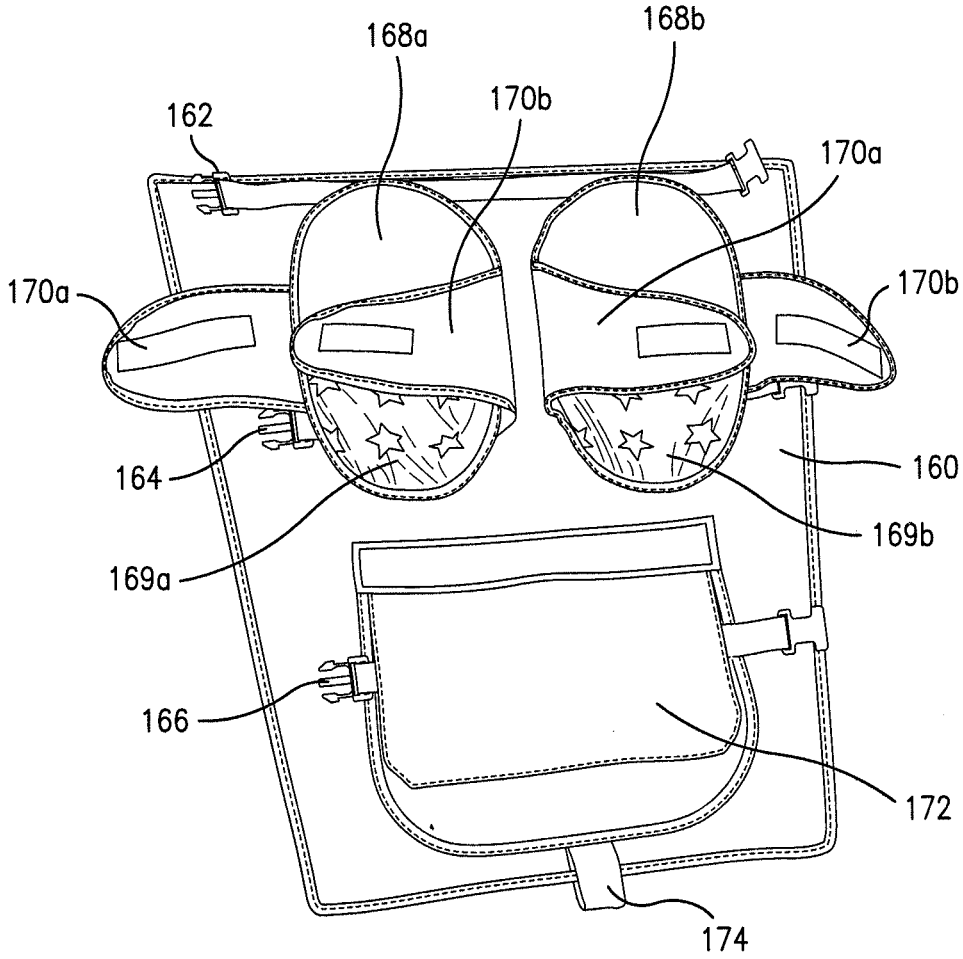
FIG. 16 is a top schematic view of a neo-natal pouch add-on according to the present invention.

FIG. 16 is a top schematic view of a neo-natal pouch add-on 160, which can be used with the mattress 10 to evacuate a mother and child(ren). The add-on preferably snaps-into the chest strap 82, the waist strap 84 and the leg strap 86, via corresponding upper strap 162, middle strap 164, and lower strap 166 (see FIG. 17). The neo-natal add-on preferably includes at least one (preferably two) baby pouches 168*a* and 168*b*. Each baby pouch includes a foot/leg receptacle 169*a*, 169*b*, and enclosure wings 170*a* and 170*b*, which are releasably fixed by buckles, elastic straps, or hook-and-loop closures, as shown. A releasably-closable pouch 172 is preferably fixed to the lower portion of the neo-natal add-on 160, below the baby pouch(es), and is configured to hold baby-care items such as bottles, pumps, diapers, lotions, clothes, etc. Preferably, the neo-natal add-on is 55 cm×45 cm×20 cm, and is gusseted to hold larger items, such as baby blankets. A loop strap 174 is preferably sewn onto the bottom of the neo-natal add-on pouch 160 so that the adjustable closure strap 28 can pass through the loop strap 174 to secure the bottom of the add-on 160 to the mattress 10.

Figure 17:
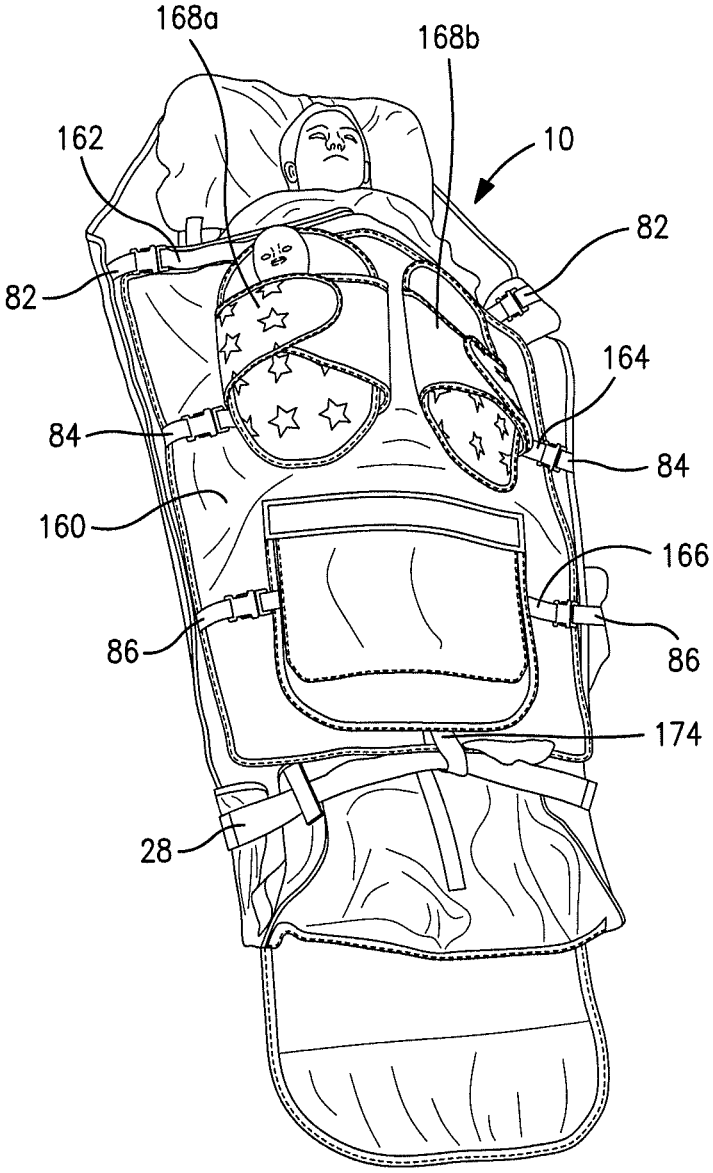
FIG. 17 is a top perspective view of the neo-natal pouch coupled to an evacuation mattress according to the FIG. 4*a* embodiment.

FIG. 17 is a top perspective view of the neo-natal pouch 160 coupled to evacuation mattress 10. As shown, the wings 16 and 18 are not used to enclose the sides of the mother, but lay primarily flat to give more room for the baby(ies). The above-described couplings with the chest, waist, leg and closure straps are as shown.

Figure 18A:
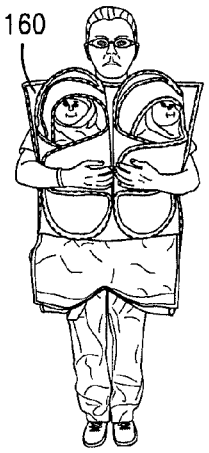
FIGS. 18*a*, 18*b*, 18*c*, 18*d*, and 18*e* are plan views of an alternative neo-natal device which may be used separately from the mattress 10.
Figure 18B:
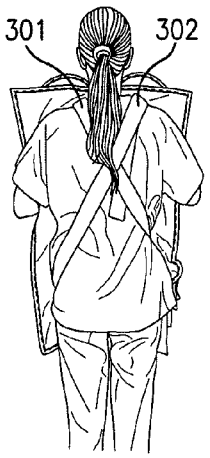
Figure 18C:
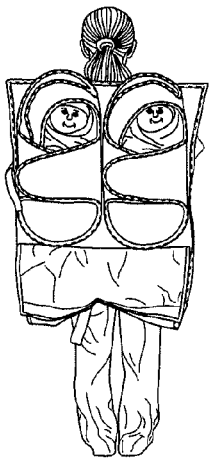
Figure 18D:
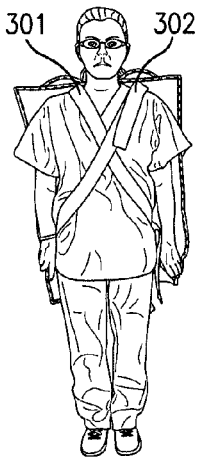
Figure 18E:
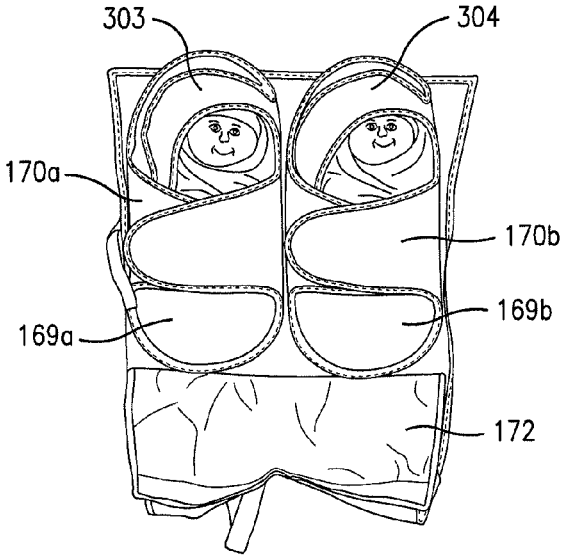

FIGS. 18*a*, 18*b*, 18*c*, 18*d*, and 18*e* are plan views of an alternative neo-natal device which may be used separately from the mattress 10. For evacuation situations where the infants are not evacuated on the mattress, the neo-natal pouch 160 can be carried by a care-giver, the mother, or other adult. For this embodiment, additional straps 301 and 302 are affixed to the back of the pouch 160. Preferably, these straps are used in a cross-configuration. FIGS. 18*a* and 18*b* show the pouch 160 strapped to the front of the care-giver, with the straps 301 and 302 crossing over her back. In FIGS. 18*c* and 18*d*, the pouch 160 is mounted on the care-giver's back, with the straps 301 and 302 crossing over her front. FIG. 18*e* is a close-up view of this embodiment of the pouch 160. Therein, optional adjustable hook-and-loop head restraints 303 and 304 are used to stabilize the heads of the infants during transport.

Figure 19:
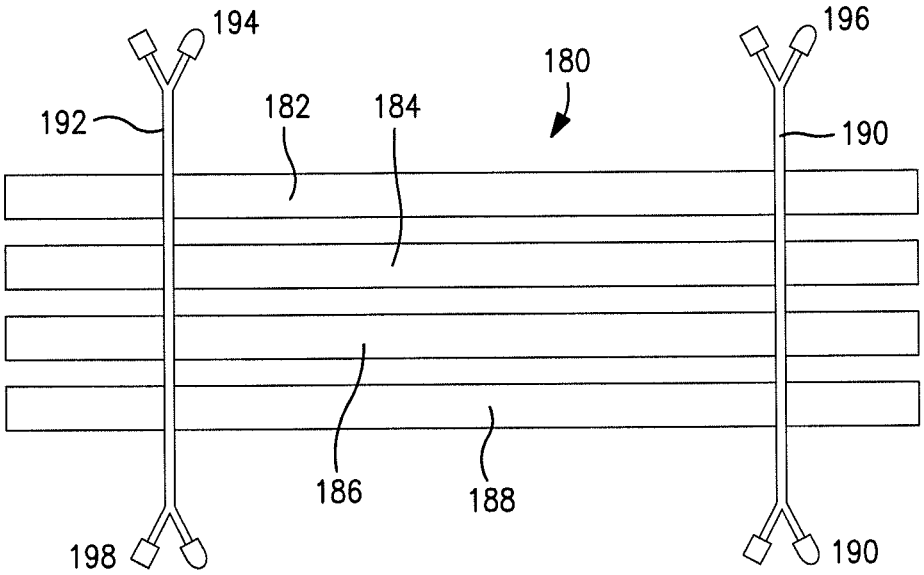
FIG. 19 is a top schematic view of a flotation add-on according to the FIG. 4*a* embodiment.
Figure 20:
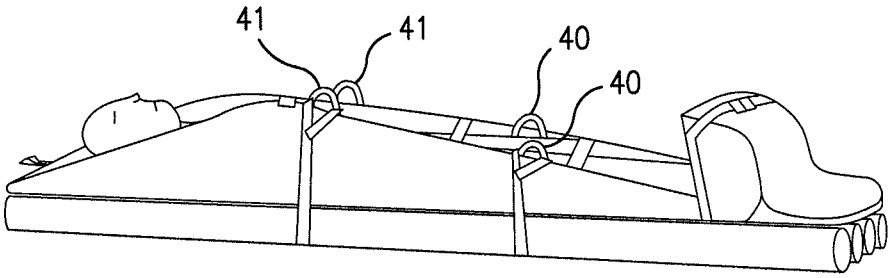
FIG. 20 is a side perspective view of the flotation add-on coupled to a patient evacuation mattress according to the FIG. 4*a* embodiment.

FIG. 19 is a top schematic view of a flotation add-on 180. preferably add-on 180 comprises four floatation tubes 182, 184, 186, and 188, as well as securing straps 190 and 192. Each floatation tube may comprise a rigid plastic tube permanently sealed, or an inflatable tube for easier storage. Preferably, the tubes are coupled together via straps 190 and 192. Preferably, the straps 190 and 190 respectively couple to handles 40 and 41, via releasable hook-and-loop fasteners 194, 196, 198, and 199, as shown in FIG. 20.

Figure 21:
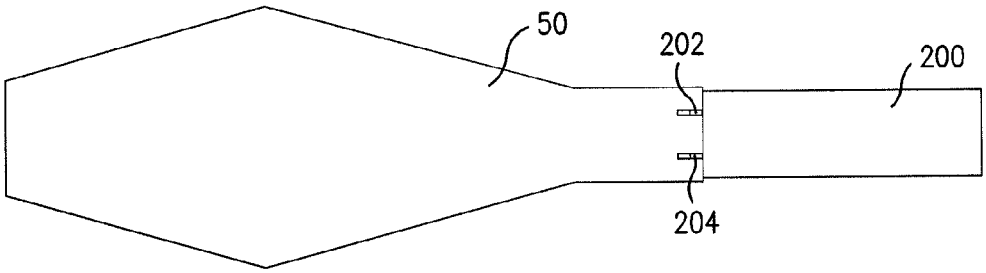

FIG. 21 is a top plan view of the bottom sheet 50 showing a thermal blanket add-on 200. The thermal blanket may comprise a Mylar emergency blanket, a plastic fleece blanket, a wool blanket, a polypropylene blanket, or any combination thereof. The thermal blanket 200 should be fire-retardant, anti-fungal, water-resistant, and easy to clean and store. Preferably, the blanket 200 may be releasably attached to the bottom sheet 50 by means such as hook-and-loop fasteners 202 and 204. The thermal blanket can be used in colder climates and/or where a patient is cold-sensitive.

Figure 22:
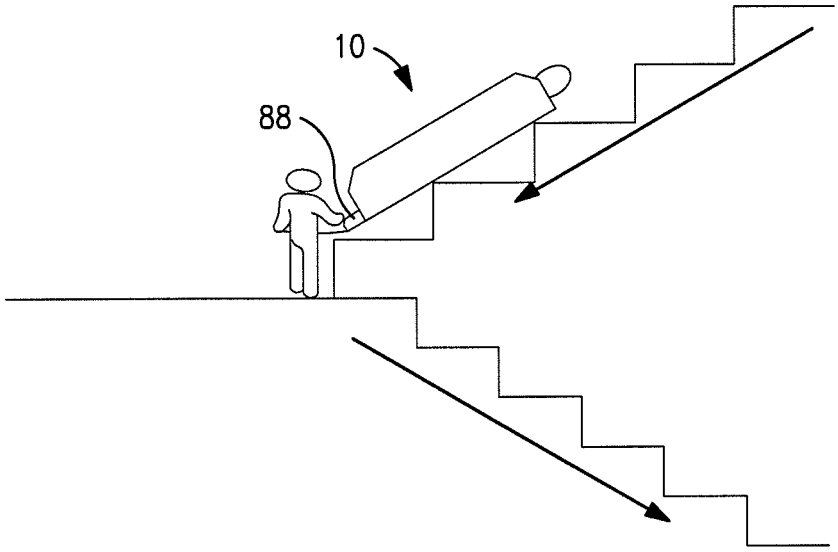
FIG. 22 is a side schematic view of the FIG. 4*a* embodiment being used in a stair descent.

FIG. 22 is a side schematic view of the mattress 10 being used in a stair descent. Quite often, hospital evacuations require patients to be evacuated down stairwells. Here, the brake portion 88 is particularly helpful. A single care-giver can still manage the patent and mattress in descent by merely placing a hand or foot on the brake portion 88 to slow or halt descent.

Figure 23:
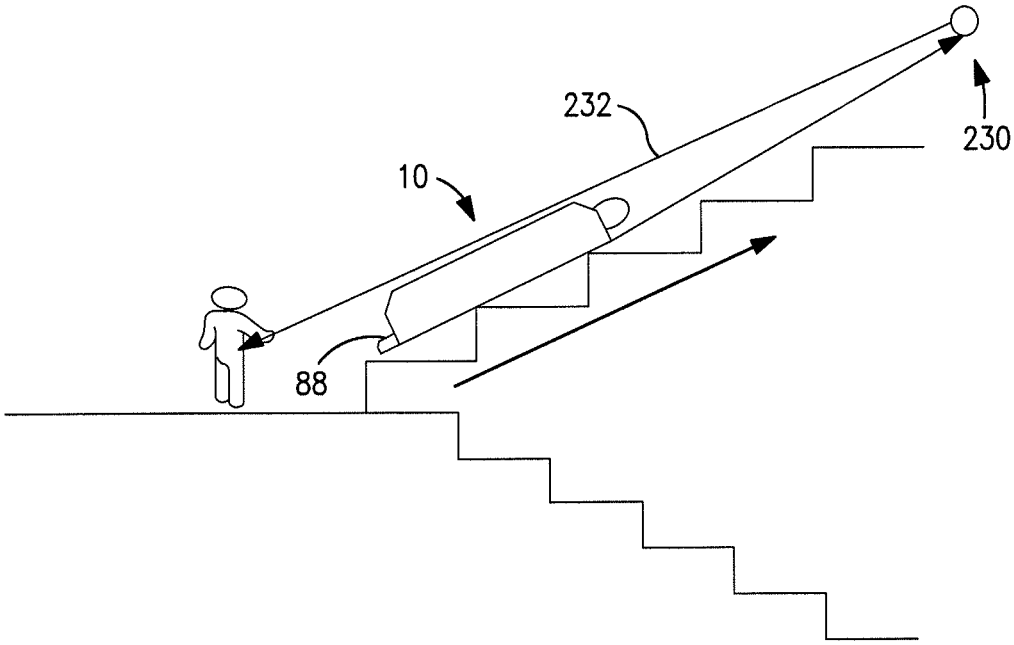
FIG. 23 is a side schematic view of the FIG. 4*a* embodiment being used in a stair ascent.

FIG. 23 is a side schematic view of the mattress 10 being used in a stair ascent. A single care-giver can still perform a stairs ascent, with the use of an ascent kit 230 (to be described below). Preferably the kit 230 includes 4:1 pulley structure so that even a heavy patient can be pulled upstairs. The brake portion 88 also can be used in an ascent, to give the care-giver a rest and an opportunity to re-adjust the towing rope 232.

Figure 24:
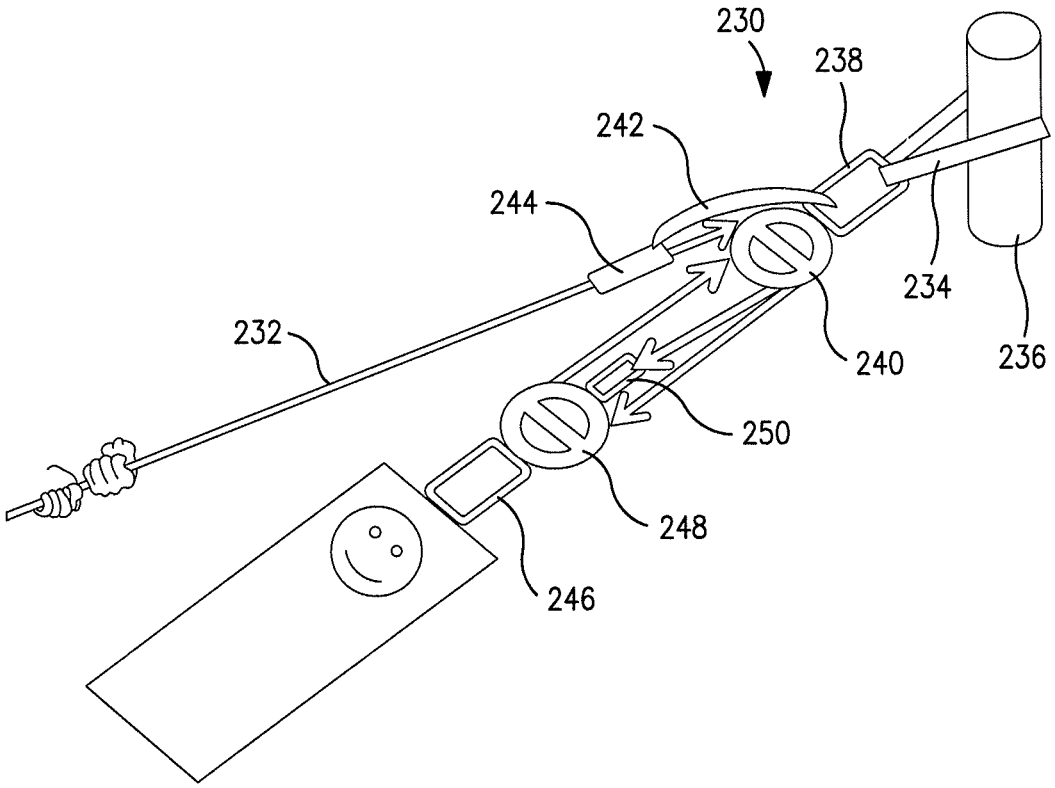
FIG. 24 is a perspective schematic view of the ascent kit devices.

FIG. 24 is a perspective schematic view of the ascent kit 230. The first step in assembling the ascent kit is to connect an anchor strap 234 to a solid anchor point 236 (such as a stair railing). A first carabineer 238 is coupled to the anchor strap 234 and to one side of a fixed twin pulley 240. A descent control strap 242 is also coupled to the first carabineer 238, and a descent control device (such as a prussic) 244 is coupled to the control strap 242. A second carabineer 246 is coupled to the mattress 10, preferably at the head tow strap 70. A travelling pulley 248 is coupled to the second carabineer 246, and an anchor carabineer 250 is attached to the other end of the travelling pulley 248. The rope 232 is then routed through the descent control device 244, over the fixed twin pulley 240, around the travelling pulley 248, again around the fixed twin pulley 240, and fixed to the anchor carabineer 250. With this arrangement, a single care-giver can hoist a patient in mattress 10 up stairs or other vertical structures. Of course, more or different types of pulleys can be used to make the ascent even easier for the care-giver.

The individual components shown in outline or designated by blocks in the attached Drawings are all well-known in the mattress and medical equipment arts, and their specific construction and operation are not critical to the operation or best mode for carrying out the invention.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

All U.S. and foreign patent documents, all articles, brochures, and all other published documents discussed above are hereby incorporated by reference into the Detailed Description of the Preferred Embodiments.

What is claimed is:

1. A roll-up patient-evacuation mattress, comprising;

a bottom sheet having a head end and a foot end;

a mattress disposed above the bottom sheet;

a patient support sheet disposed above the mattress, the patient support sheet having a left wing and a right wing which are dimensioned to respectively enclose at least portions of left and right sides of a patient lying on the patient support sheet; and a foot section coupled to the bottom sheet and dimensioned to substantially enclose the patient-evacuation mattress when the bottom sheet, the mattress, and the patient support sheet are rolled from the head end to the foot end in a direction substantially parallel to a longitudinal axis of the patient-evacuation mattress into said foot section, wherein, when rolled into said foot section, the bottom sheet and the patient support sheet form a roll shape having a transverse cross section with (i) two substantially flat sides disposed at a substantial right angle with respect to each other, and (ii) a substantially quarter cylindrical side connected with the two substantially flat sides.

2. A roll-up patient-evacuation mattress according to claim 1, further comprising at least one releasable strap configured to hold the patient-evacuation mattress in the substantially cylindrical shape.

3. A roll-up patient-evacuation mattress according to claim 2, wherein the at least one releasable strap comprises at least one releasable, circumferentially-extending strap and at least one releasable end strap extending substantially perpendicular to said circumferentially-extending strap.

4. A roll-up patient-evacuation mattress according to claim 1, further comprising a carrying handle coupled to the foot section.

5. A roll-up patient-evacuation mattress according to claim 4, wherein the carrying handle has a neoprene portion.

6. A roll-up patient-evacuation mattress according to claim 1, further comprising a shoulder strap coupled to the foot section.

7. A roll-up patient-evacuation mattress according to claim 1, further comprising (i) a head towing strap coupled to the head end and (ii) a foot towing strap coupled to the foot end, each towing strap configured so that an ambulatory care-giver can tow a patient lying on said patient support surface.

8. A roll-up patient-evacuation mattress according to claim 1, wherein each of the left wing and the right wing has a substantially triangular shape configured so that, when an adult-sized patient is lying on the patient support surface, the patient's face is exposed.

9. A roll-up patient-evacuation mattress according to claim 1, further comprising two lifting handles coupled to each of the left wing and the right wing, the carrying handles being configured such that two care-givers can lift a patient lying on the patient support surface.

10. A roll-up patient-evacuation mattress according to claim 1, further comprising a first plastic support sheet disposed between the bottom sheet and the mattress.

11. A roll-up patient-evacuation mattress according to claim 10, wherein the first plastic support sheet is fixed to the mattress.

12. A roll-up patient-evacuation mattress according to claim 10, further comprising a second plastic support sheet disposed beneath the bottom sheet.

13. A roll-up patient-evacuation mattress according to claim 12, wherein the second plastic support sheet is configured as a skid plate.

14. A roll-up patient-evacuation mattress according to claim 12, wherein each of the first plastic support sheet and the second plastic support sheet extends from the head end to the foot end.

15. A roll-up patient-evacuation mattress according to claim 1, further comprising at least two releasable patient-securing straps disposed substantially perpendicular to the longitudinal axis of the patient-evacuation mattress and configured to secure a patient lying on the patient support surface.

16. A roll-up patient-evacuation mattress according to claim 15, wherein the two releasable patient-securing straps are coupled to each of the left wing and the right wing.

17. A roll-up patient-evacuation mattress according to claim 1, wherein the mattress comprises a foam mattress.

18. A roll-up patient-evacuation mattress according to claim 1, further comprising at least two spinal boards disposed above the bottom sheet, each spinal board extending in a direction substantially perpendicular to the longitudinal axis of the patient-evacuation mattress, the at least two spinal boards being articulatable with respect to each other about an axis substantially perpendicular to the longitudinal axis of the patient-evacuation mattress so that, when the bottom sheet, the mattress, and the patient support sheet are rolled from the head end to the foot end in the direction substantially parallel to a longitudinal axis of the patient-evacuation mattress, the at least two spinal boards articulate with respect to each other and fit within said foot section.

19. A roll-up patient-evacuation mattress according to claim 18, wherein the at least two spinal boards are disposed more toward the head end than the foot end.

20. A roll-up patient-evacuation mattress according to claim 18, wherein each spinal board has at least three wheel assemblies fixed thereto and extending through corresponding openings in the bottom sheet.

21. A roll-up patient-evacuation mattress according to claim 20, wherein each spinal board has at least one wheel assembly disposed on a head side of the spinal board, at least one wheel assembly disposed on a foot side of the spinal board, and at least one wheel assembly disposed in a middle of the spinal board.

22. A roll-up patient-evacuation mattress according to claim 21, further comprising a plastic skid plate disposed below the bottom sheet, said plastic skid plate having at least one opening therein through which protrude the spinal board wheel assemblies.

23. A roll-up patient-evacuation mattress according to claim 22, further comprising at least two fabric wear sheets disposed between the bottom sheet and the plastic skid plate, and configured to protect the bottom sheet from wear.

24. A roll-up patient-evacuation mattress according to claim 1, further comprising:

at least two releasable securing straps disposed substantially perpendicular to the longitudinal axis of the patient-evacuation mattress; and a neo-natal pouch configured to be coupled to the at least two releasable securing straps, and to secure an infant therewithin.

25. A roll-up patient-evacuation mattress according to claim 1, further comprising a brake portion coupled to said foot section and extending in a direction away from the head end, and configured to brake a sliding movement of the patient-evacuation mattress when a care-giver applies a downward pressure thereto.

26. A roll-up patient-evacuation mattress, comprising:

a bottom sheet having a head end and a foot end;

a mattress disposed above the bottom sheet;

a first plastic support sheet disposed between the bottom sheet and the mattress;

a second plastic support sheet disposed beneath the bottom sheet;

a patient support sheet disposed above the mattress, the patient support sheet having a left wing and a right wing which are dimensioned to respectively enclose at least portions of left and right sides of a patient lying on the patient support sheet; and a foot section coupled to the bottom sheet and dimensioned to substantially enclose the patient-evacuation mattress when the bottom sheet, the mattress, and the patient support sheet are rolled from the head end to the foot end in a direction substantially parallel to a longitudinal axis of the patient-evacuation mattress into said foot section, wherein each of the first plastic support sheet and the second plastic support sheet comprises two plastic sheet layers having plural connecting plastic portions extending in a direction substantially perpendicular to the longitudinal axis of the patient-evacuation mattress.

27. A patient-evacuation mattress, comprising:

a flexible bottom plastic sheet having a head end and a foot end;

a first semi-rigid plastic sheet disposed above the bottom sheet;

a foam mattress disposed above the first semi-rigid plastic sheet;

a flexible plastic patient support sheet disposed above the foam mattress;

a second semi-rigid plastic sheet disposed below the bottom sheet; and at least two spinal boards disposed between the bottom sheet and the first semi-rigid plastic sheet, each spinal board extending in a direction substantially perpendicular to a longitudinal axis of the patient-evacuation mattress and having at least three wheel assemblies coupled to a bottom surface thereof, the bottom sheet and the second semi-rigid plastic sheet each having at least one opening therein configured so that the spinal board wheel assemblies extend therethrough.

28. A patient-evacuation sled, comprising:

a bottom sheet having a top end, a bottom end, a right side, and a left side;

a mattress disposed above the bottom sheet;

a rigid support member disposed between the bottom sheet and the mattress and extending from a middle of the bottom sheet toward the left and right sides thereof;

at least two spinal boards disposed between the bottom sheet and the mattress, each spinal board extending in a direction substantially perpendicular to a longitudinal axis of the patient-evacuation mattress and having at least three wheel assemblies coupled to a bottom surface thereof;

each of the three wheel assemblies being configured to extend through the bottom sheet; and a foot section coupled to the bottom sheet and configured to substantially enclose the feet of a patient lying above said mattress.

29. A patient-evacuation device, comprising:

a bottom sheet having a top end, a bottom end, a right side, and a left side;

a mattress disposed above the bottom sheet;

a rigid support member disposed between the bottom sheet and the mattress and extending from a middle of the bottom sheet toward the left and right sides thereof;

plural wheel assemblies coupled to the rigid member and configured to extend through the bottom sheet; and a left patient-enclosure flap coupled to the bottom sheet left side and configured to enclose at least a portion of a left side of a patient lying above said mattress;

a right patient-enclosure flap coupled to the bottom sheet right side and configured to enclose at least a portion of a right side of a patient lying above said mattress;

plural patient-enclosure straps coupled to the left and right patient-enclosure flaps and configured to secure the patient to the evacuation device;

wherein the left and right patient-enclosure flaps are configured to leave permanently exposed the head and knees of the patient lying above said mattress; and a foot section coupled to the bottom sheet and dimensioned to substantially enclose the patient-evacuation device when the bottom sheet, the mattress, and the patient-enclosure flaps are rolled from the head end to the bottom end in a direction substantially parallel to a longitudinal axis of the patient-evacuation device into said foot section, wherein, when rolled into said foot section, the bottom sheet and the patient-enclosure flaps form a roll shape having a transvers cross section with (i)two substantially flat sides disposed at a substantial right angle with respect to each other, and (ii) a substantially quarter cylindrical side connected with the two substantially flat sides.

* * * * *